US007274903B2

(12) United States Patent
Carter et al.

(10) Patent No.: US 7,274,903 B2
(45) Date of Patent: Sep. 25, 2007

(54) INTEGRATED FUSER UNIT AND DRIVE SYSTEM FOR USE IN AN ELECTROPHOTOGRAPHIC IMAGING PROCESS

(75) Inventors: Daniel Lee Carter, Georgetown, KY (US); Edward Lawrence Kiely, Lexington, KY (US); Edward Alan Rush, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 184 days.

(21) Appl. No.: 10/809,656

(22) Filed: Mar. 25, 2004

(65) Prior Publication Data

US 2005/0214041 A1 Sep. 29, 2005

(51) Int. Cl.
*G03G 15/20* (2006.01)

(52) U.S. Cl. ..... 399/320; 399/328

(58) Field of Classification Search ..... 399/320, 399/328

See application file for complete search history.

(56) References Cited

U.S. PATENT DOCUMENTS

| | | | | |
|---|---|---|---|---|
| 3,942,887 | A | 3/1976 | McCarroll | 355/3 |
| 4,086,871 | A | 5/1978 | Rydeen et al. | 118/60 |
| 4,118,178 | A | 10/1978 | Calvi et al. | 432/35 |
| 4,145,181 | A | 3/1979 | Edwards et al. | 432/60 |
| 4,154,575 | A | 5/1979 | Edwards et al. | 432/60 |
| 4,257,282 | A | 3/1981 | Wilczewski et al. | 74/125 |
| 4,327,992 | A | 5/1982 | Babicz | 355/3 |
| 4,419,007 | A | 12/1983 | Kingsley | 355/14 |
| 4,464,985 | A | 8/1984 | Asanuma et al. | 100/47 |
| 4,484,825 | A | 11/1984 | Wilczewski et al. | 400/124 |
| 4,487,506 | A | 12/1984 | Repp et al. | 355/14 |
| 4,498,757 | A | 2/1985 | Lance et al. | 355/3 |
| 4,716,435 | A | 12/1987 | Wilson | 355/3 |
| 4,772,913 | A * | 9/1988 | Watanabe | 399/321 |
| 4,806,097 | A | 2/1989 | Palm et al. | 432/60 |
| 4,806,968 | A | 2/1989 | Watanabe et al. | 355/3 |
| 4,891,665 | A | 1/1990 | Mizutani | 355/75 |
| 4,928,141 | A | 5/1990 | Poehlein et al. | 355/208 |
| 4,931,834 | A | 6/1990 | Suga | 355/200 |
| 4,954,845 | A * | 9/1990 | Yano et al. | 399/329 |
| 5,060,025 | A | 10/1991 | Kümmel et al. | 355/319 |
| 5,124,756 | A | 6/1992 | Stelter | 355/290 |
| 5,148,220 | A | 9/1992 | Hilbert et al. | 355/245 |
| 5,280,224 | A | 1/1994 | Sagara | 318/265 |
| 5,289,248 | A | 2/1994 | Kurokawa | 355/285 |
| 5,359,181 | A | 10/1994 | Waechtler et al. | 219/216 |
| 5,365,320 | A | 11/1994 | Takano et al. | 355/282 |
| 5,384,629 | A | 1/1995 | Watanabe et al. | 355/260 |
| 5,430,468 | A | 7/1995 | Sasai et al. | 346/136 |
| 5,479,247 | A | 12/1995 | Watanabe et al. | 355/260 |
| 5,488,464 | A | 1/1996 | Wenthe, Jr. et al. | 355/233 |
| 5,488,467 | A | 1/1996 | Marentes et al. | 355/282 |
| 5,488,469 | A | 1/1996 | Yamamoto et al. | 356/72 |
| 5,493,374 | A | 2/1996 | Smith et al. | 355/282 |

(Continued)

FOREIGN PATENT DOCUMENTS

JP 09230723 A * 9/1997

*Primary Examiner*—Quana Grainger
(74) *Attorney, Agent, or Firm*—Taylor & Aust, P.C.

(57) ABSTRACT

An integrated fuser unit has a drive system with a motor and a drive train mounted in the fuser unit frame. A swing arm assembly engages and disengages the hot roll from the drive train.

13 Claims, 3 Drawing Sheets

U.S. PATENT DOCUMENTS 5,541,714 A 7/1996 Watanabe et al. ..... 355/260
5,701,549 A 12/1997 Portig et al. ..... 399/36
5,708,927 A 1/1998 Etoh ..... 399/122
5,732,319 A 3/1998 Komuro et al. ..... 399/331
5,764,372 A 6/1998 Kondo ..... 358/414
5,772,343 A 6/1998 Beretta et al. ..... 400/624
5,805,310 A 9/1998 Jean et al. ..... 358/498
5,815,772 A 9/1998 Saito et al. ..... 399/107
5,820,275 A 10/1998 Crawford et al. ..... 400/185
5,825,396 A 10/1998 Fujishiro ..... 347/212
5,839,036 A 11/1998 Shogren ..... 399/213
5,937,262 A 8/1999 Cho ..... 399/401
5,956,543 A 9/1999 Aslam et al. ..... 399/45
5,974,283 A 10/1999 Cho ..... 399/75
5,987,294 A 11/1999 Yoda et al. ..... 399/328
6,009,285 A 12/1999 Barry et al. ..... 399/12
6,018,640 A 1/2000 Blackman et al. ..... 399/364
6,029,020 A 2/2000 Blackman et al. ..... 399/45
6,035,160 A * 3/2000 Kim ..... 399/122
6,116,797 A 9/2000 Brewington et al. ..... 400/621
6,167,231 A 12/2000 Blackman et al. ..... 399/364
6,173,136 B1 1/2001 Fuchiwaki et al. ..... 399/67
6,182,550 B1 2/2001 Brewington et al. ..... 83/603
6,253,046 B1 6/2001 Horrall et al. ..... 399/124
6,290,410 B1 9/2001 Sunada et al. ..... 400/624
6,292,646 B1 9/2001 Maul et al. ..... 399/325
6,293,716 B1 9/2001 Driggers et al. ..... 400/578
6,332,068 B2 12/2001 Blackman et al. ..... 399/364
6,343,787 B1 2/2002 Kato et al. ..... 271/274
6,347,205 B1 2/2002 Morganti et al. ..... 399/122
6,385,431 B1 5/2002 Arcaro et al. ..... 399/381
6,443,446 B1 9/2002 Kiesow et al. ..... 271/184
6,484,008 B2 11/2002 Arcaro et al. ..... 399/301
6,539,189 B2 3/2003 Yanagida ..... 399/167
6,553,204 B1 4/2003 Yamada ..... 399/328
6,556,798 B2 4/2003 Rimai et al. ..... 399/167
6,584,298 B2 6/2003 Omoto et al. ..... 399/330
6,615,005 B2 9/2003 Maruyama ..... 399/67
6,618,572 B2 9/2003 Morganti et al. ..... 399/327
6,650,852 B2 11/2003 Makino ..... 399/122
2003/0113133 A1 6/2003 Ryuzaki et al. ..... 399/167
2003/0170048 A1 9/2003 Ahn ..... 399/167
2003/0215265 A1 11/2003 Kawai ..... 399/167
2003/0215272 A1 11/2003 Morganti et al. ..... 399/327

* cited by examiner

INTEGRATED FUSER UNIT AND DRIVE SYSTEM FOR USE IN AN ELECTROPHOTOGRAPHIC IMAGING PROCESS

BACKGROUND OF THE INVENTION

1. Field of the Invention

The present invention relates generally to electrophotographic printing devices and, more particularly, to drive systems for the fuser units of electrophotographic printing devices.

2. Description of the Related Art

In the electrophotographic (EP) imaging process used in printers, copiers and the like, a photosensitive member, such as a photoconductive drum or belt, is uniformly charged over an outer surface. An electrostatic latent image is formed by selectively exposing the uniformly charged surface of the photosensitive member. Toner particles are applied to the electrostatic latent image, and thereafter the toner image is transferred to the media intended to receive the final permanent image. The toner image is fixed to the media by the application of heat and pressure in a fuser.

A fuser is known to include a heated roll and a backup roll forming a fuser nip through which the media passes. At least one of the rolls is driven, along with a variety of infeed and outfeed rolls to transport the media to and from the nip. If two-sided printing is provided, a duplexing path to reverse the media also includes driven rolls to transport the media along the duplexing path. A fuser drive system drives the aforementioned rolls, perhaps also together with other fuser components.

Known designs for drive systems of fuser units in electrophotographic printing devices incorporate a portion of the fuser drive system in the machine separate from the fuser unit itself. The machine side of the fuser drive system is known to include a motor and a portion of a drive train, and includes a mounting plate, studs and at least one gear. It is also known to use a belt pulley drive system in a fuser unit drive system. It also is known to use the machine side motor to drive more than just the fuser unit components. For example, the motor may also drive components within the paper path or EP system. The remainder of the fuser drive system is included in the fuser unit, and includes at least one gear of the drive train that engages a gear on the machine side of the drive system.

In a known design, the motor that drives the fuser and other paper feed modules is located on a bracket mounted to the machine frame. A fuser drive gear on the machine side mates with an input gear located on the fuser upon insertion of the fuser unit. Each time the fuser unit is removed and installed, such as for servicing or replacement, the drive system is separated and re-engaged. This making and breaking of the drive train creates design challenges and potential problems such as sub-optimal gear center distance control, which can lead to premature gear wear and noise.

It is known to provide the fuser unit as a customer replaceable unit (CRU) or as a field replaceable unit (FRU) intended to be serviced or replaced by a field technician. With the drive system split between the machine side and the fuser unit side of the device, gear center distance can vary across the module boundaries. Gear life can be shortened and objectionable noise created if the mating gears on the machine side and the fuser unit side are not optimally positioned. Further, during the life of an electrophotographic printer, a fuser unit may be replaced several times. Since the motor and a portion of the drive train are not part of the fuser unit, old components of the drive system remain when the fuser unit is replaced. An old, partially worn gear on the machine side must mate with a new, non-worn gear on the fuser unit. Optimal gear engagement might not result, and increased noise and wear may occur immediately when the new fuser unit is installed.

What is needed in the art is an integrated drive train that is self-contained within the fuser unit, to simplify machine architecture and improve machine performance and reliability.

SUMMARY OF THE INVENTION

The present invention provides a drive motor and drive train mounted on and contained within the fuser unit. A swing arm is provided to engage and disengage the hot roll, facilitating bi-directional drive for duplexing.

The invention comprises, in one form thereof, a fuser unit for an EP printing device. The fuser unit has a unit frame, a hot roll mounted in the frame, and a backup roll mounted in the frame and disposed in nipped relationship with the hot roll. A fuser drive motor and a drive train are mounted in the frame and drivingly connected. The drive train has at least one gear for driving at least one of the hot roll and the backup roll.

The invention comprises, in another form thereof, a drive system for a fuser having a fuser unit frame and a hot roll mounted in the frame. The drive system has a motor mounted in the frame, and a drive train operatively connected to the motor. The drive train includes a plurality of individual gears each mounted to the frame and including a hot roll gear in the drive train for driving the hot roll.

In still another form thereof, the invention provides a method for operating a fuser of an EP printing device, with steps of providing a frame, a hot roll, a drive train and a drive motor as an integral unit; providing a hot roll gear as part of the drive train, operating the drive motor in a first direction when passing media past the hot roll; and operating the drive motor in an opposite direction for routing the media to a duplexing path.

An advantage of the present invention is providing improved gear center distance control for all gears in the fuser drive train, thereby minimizing tolerance variations between gear centers, improving gear life and reducing noise.

Another advantage is providing improved machine reliability by replacing the motor and all drive components each time the fuser unit is replaced.

A further advantage of the present invention is using the fuser motor to drive the machine output rolls in a reverse direction to feed media into a duplexing path, thereby eliminating the need for an additional duplexer drive motor.

A still further advantage of the present invention is disconnecting the fuser nip rolls from the drive system as the media is routed to a duplex path, thereby reducing the power needed from the motor, and enabling the motor to turn faster and reduce dead time from duplex routing.

Yet another advantage of the present invention is changing the direction of drive train rotation without disengaging the drive motor, providing a substantially instantaneous reversal.

Still another advantage of the present invention is reducing manufacturing cost by minimizing mounting hardware in the base machine frame.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
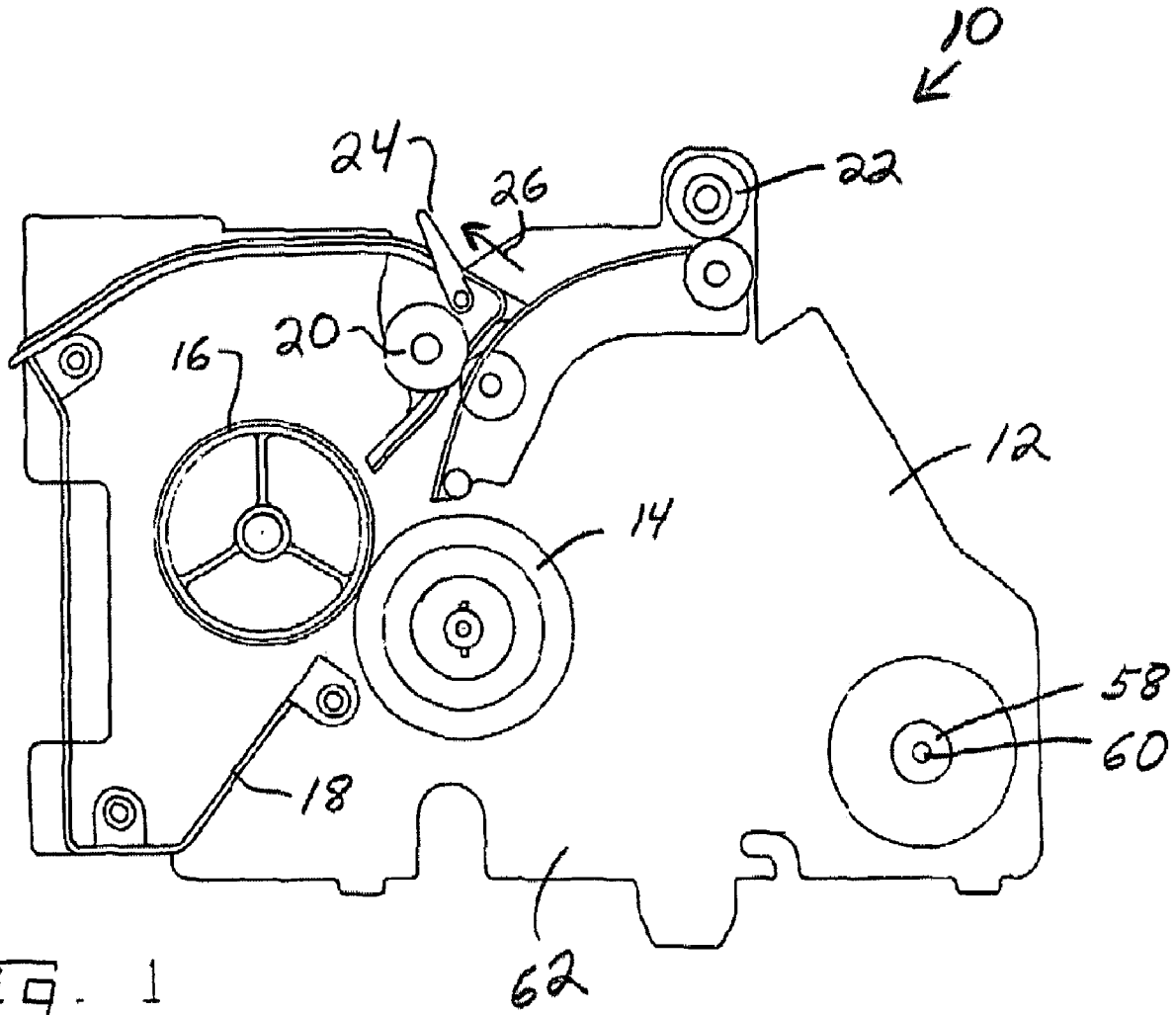
FIG. 1 is a side elevational view of a fuser unit having an integrated drive system in accordance with the present invention, shown with the drive train removed for added clarity.

Referring now to the drawings and particularly to FIG. 1, there is shown an embodiment of a fuser unit 10 for an electrophotographic (EP) printing device in accordance with the present invention. Fuser unit 10 can be adapted for use in a printer, copier or other printing device using the electrophotographic process requiring a fuser unit to permanently adhere toner particles to the media being printed. Fuser unit 10 can be provided for use in a color printing device or a monochrome printing device.

Fuser unit 10 includes a frame 12 consisting of a variety of substantially ridged members such as plates, bars and the like securely affixed to one another to form a substantially ridged supporting structure for the remaining components of fuser 10. Frame 12 is adapted for mounting in the printing device, and may be provided as a customer replaceable unit (CRU), or a field replaceable unit (FRU). While the features of the present invention also can be used in a fuser integrated directly into the machine frame, the invention has particular advantages for replaceable fuser units including those of the aforementioned CRU and FRU designs.

In general, fuser unit 10 includes a hot roll 14 heated in known manner, such by a lamp within roll 14. A backup roll 16 is disposed in nipped relationship to hot roll 14, and heat and pressure are applied to media passing through the nip formed between hot roll 14 and backup roll 16. Hot roll 14 and backup roll 16 are metal, such as aluminum, and have a cover of an elastomer, which can be a silicone rubber covered by a PFA sleeve. A media path defined by an entry guide member 18 directs media between hot roll 14 and backup roll 16. An exit path includes one or more exit rolls 20 from the fusing nip and output rolls 22 from fuser 10, at least some of which are driven. In the exemplary embodiment shown in the drawings, fuser unit 10 includes a sensor flag/diverter assembly 24 for a duplexing path indicated by arrow 26 to provide imaging on both sides of media processed through fuser unit 10. The present invention can also be used in printing devices not having duplexing features.

Figure 2:
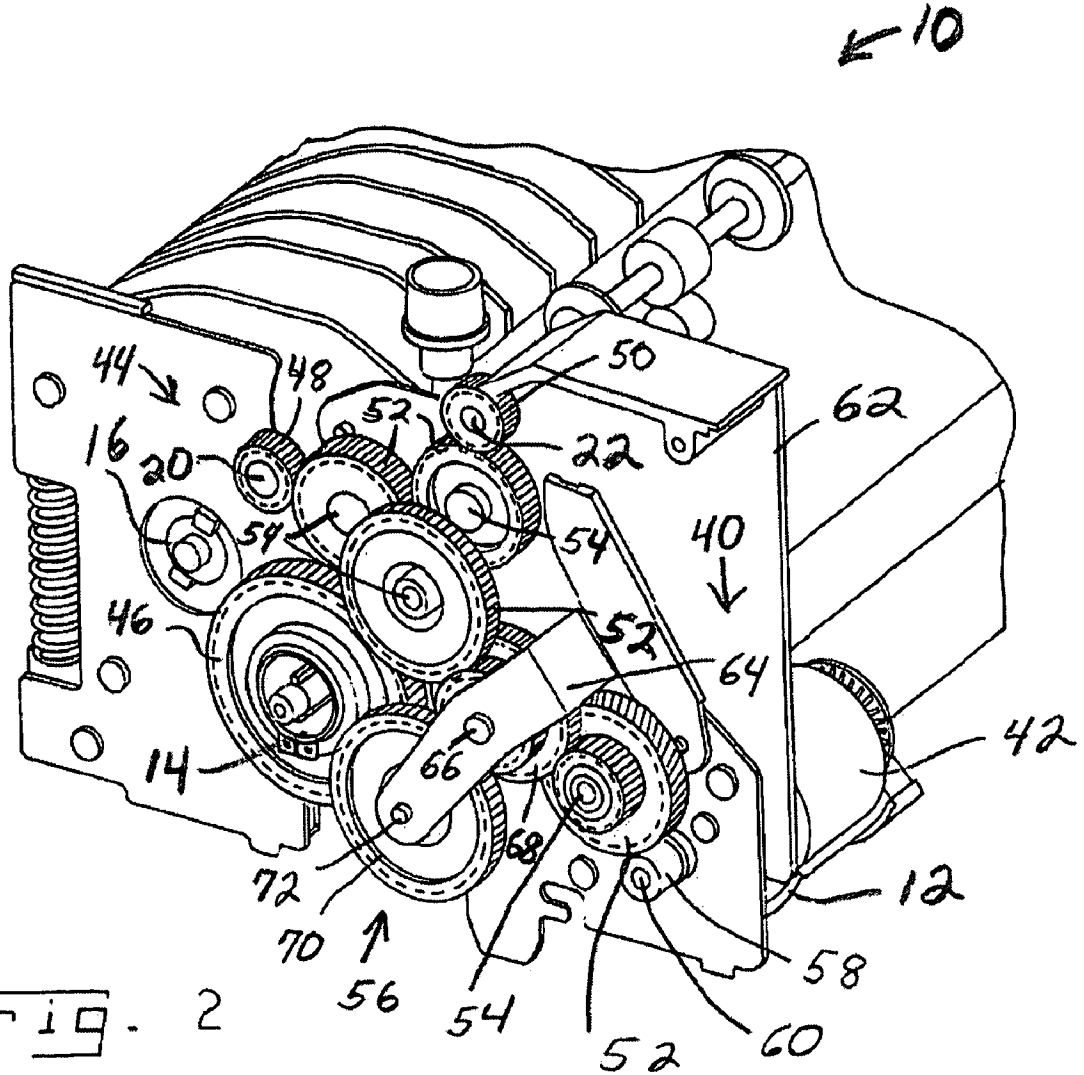
FIG. 2 is a perspective view of the fuser unit shown in FIG. 1, shown with the drive train in place.

With reference now to FIG. 2, a fuser unit drive system 40 is shown for driving hot roll 14 and the various other driven rolls and components of fuser 10. Drive system 40 includes a fuser motor 42 mounted to fuser frame 12 and operatively connected to a drive train 44. While the exemplary embodiment of drive train 44 shown in the drawings is a gear train 44, those skilled in the art will understand that drive train 44 can include a series of interconnected gears, a belt drive system of belts and pulleys or a combination of belts, pulleys and gears. As used herein, including in the claims, the term "drive train" is intended to include such variations, and individual elements such as gears, pulleys or belts of the drive train shall be referred to collectively as components of the drive train.

Drive train 44 includes a hot roll gear 46 connected to hot roll 14 for rotating hot roll 14, an exit drive gear 48 connected to driven exit roll 20 for driving exit roll 20, and an output drive gear 50 connected to driven output roll 22, for driving output roll 22. A variety of additional gears 52 in drive train 44 are provided for rotating other components of the printing device or as idling gears on studs 54 in fuser housing 12, for speed and rotational directional control and adjustment in drive train 44. Additional gears 52 can be of different gear types, as necessary, including both single and compound gears rotatably mounted on studs 54.

A swing arm assembly 56 is incorporated into drive system 40 and functions as a clutch to engage and disengage hot roll gear 46 from drive train 44, as will be described more fully hereinafter. Drive system 40, including drive motor 42, drive train 44 and swing arm assembly 56, is fully integrated into fuser unit 10, contained within fuser frame 12, so that installation and removal requires only making and breaking electrical connections to fuser unit 10 from the base machine, in addition to completing physical attachment of the fuser unit in the base machine.

Figure 3:
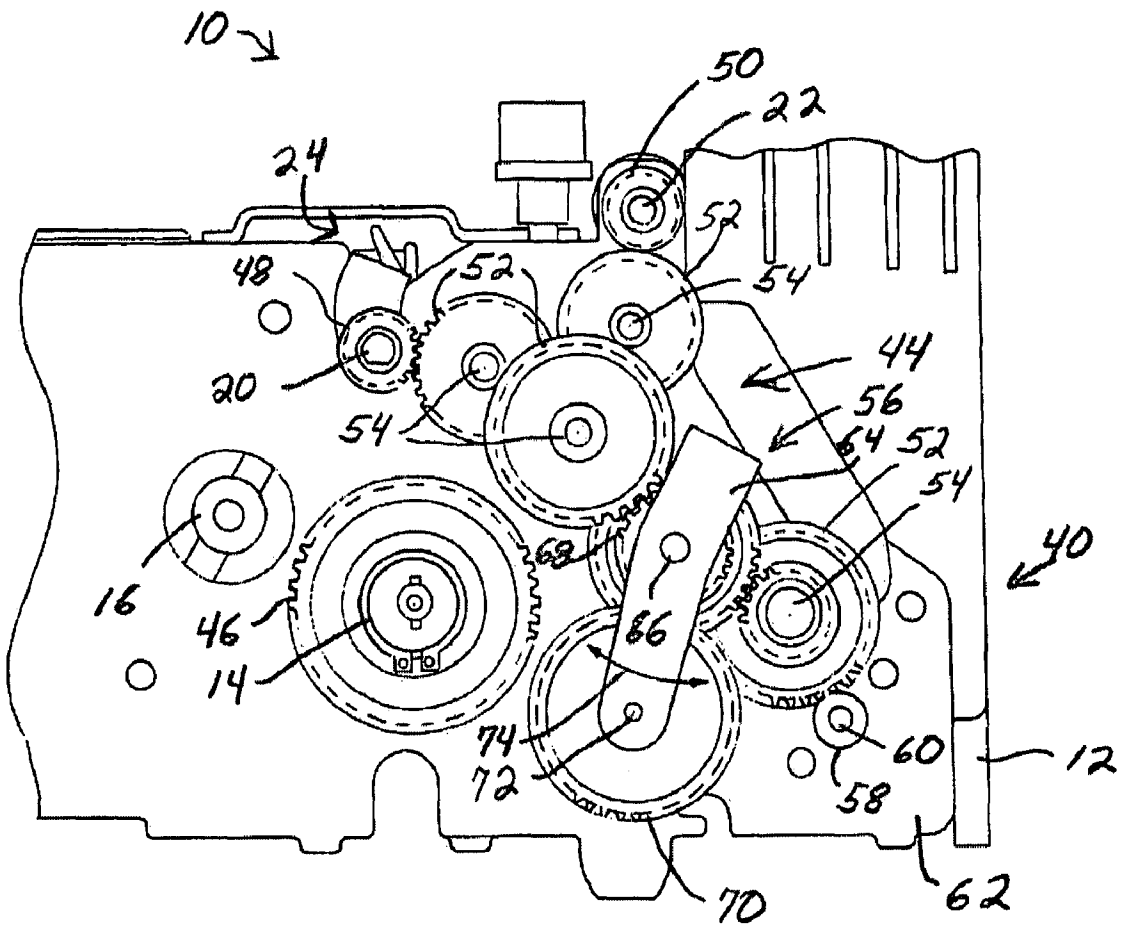
FIG. 3 is a fragmentary side elevational view of the fuser unit, illustrating bi-directional swing arm movement of the fuser unit.

Fuser motor 42 is a bi-directional DC motor with encoder feedback for velocity control. Motor 42 includes a pinion gear 58 on motor shaft 60, which rotates in a first direction for normal printing and in the opposite direction for duplex processing. FIG. 2 illustrates the condition of drive system 40 during normal printing, with motor shaft 60 being rotated in a clockwise direction with respect to the perspective shown for fuser 10. FIG. 3 illustrates the condition of drive system 40 during duplex routing, with motor shaft 60 being rotated in a counter-clockwise direction with respect to the perspective shown for fuser 10.

Advantageously, motor shaft 60 and all gears of drive train 44 are located positionally by a side plate 62 of frame 12, so that center distance between gears are easily established and well controlled. All gear stud, roll shaft and other locating holes can be punched in plate 62 at the same time from a single die to provide precisely located positions with respect to one another. Gear centers are located precisely with respect to each other, facilitating the use of fine pitched, plastic gears commonly used in printers and copiers. The potential for gear breakage, gear noise, premature wear of the gears and inconsistent performance are reduced.

Swing arm assembly 56 includes a bracket 64 rotatably connected about a pivot 66. A primary gear 68 of assembly 56 is rotatably mounted to plate 62 through pivot 66, and is continuously engaged in drive train 44, to be driven in both clockwise and counterclockwise directions. Primary gear 68 is drivingly engaged with a speed adjusting gear 70 that is rotatable relative to bracket 64 through a stud 72. A compound drive gear (not shown) inwardly of gear 70 on stud 72 can be engaged with and disengaged from hot roll gear 46 upon movement of bracket 64 about pivot 66. Internal friction within swing arm assembly 56, such as between bracket 64, gear 68, gear 70 and/or pivot 66 cause pendulum-like movement of bracket 64 about pivot 66, as indicated by arrow 74. In the normal printing mode, with motor 42 rotating clockwise, bracket 64 is rotated clockwise about pivot 66 and is positioned toward hot roll gear 46, which is engaged in drive train 44 for rotation of hot roll 14. During duplex operation, the rotational direction of motor 42 is reversed. As motor 42 begins rotating in a counterclockwise direction, the rotational direction of primary gear 68 is reversed, and the internal friction between the components of swing arm assembly 56 causes bracket 64 to rotate counterclockwise about pivot 66 and swing away from hot roll gear 46. Bracket 64 moves sufficiently to disengage hot roll gear 46 from drive train 44.

By disengaging hot roll gear 46 from drive train 44, neither hot roll 14 nor backup roll 16 is turned by fuser motor 42 during reverse direction rotation of fuser motor 42. The resultant reduction in load on motor 42 allows motor 42 to be rotated at higher velocity during duplex routing, without requiring a larger, more expensive motor. Higher velocity results in greater duplex efficiency due to returning media faster for second side imaging. The swing arm also allows hot roll 14 to be freewheeling for clearing paper jams in the process direction. Fuser exit drive gear 48 and output drive gear 50 are direct driven through a separate branch of drive train 44 from hot roll gear 46, are continuously connected and driven by motor 42, in both directions of motor rotation. This allows for substantially instantaneous direction changes in the output rolls, improving duplex efficiency compared to designs requiring engagement and disengagement of the output put rolls for direction reversal.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fuser unit for an EP printing device, said fuser unit comprising:

a unit frame;

a hot roll mounted in said frame;

a backup roll mounted in said frame and disposed in nipped relationship with said hot roll;

a fuser drive motor mounted in said frame;

a drive train mounted in said frame and drivingly connected to said fuser drive motor, said drive train having at least one component thereof for driving at least one of said hot roll and said backup roll; and media drive rolls defining a duplexing path in said fuser, said drive train having at least another component thereof for driving said media drive rolls, said drive train adapted to be uncoupled from said hot roll during duplex routing of media through said fuser.

2. The fuser of claim 1, said fuser motor being bidirectional for rotating in a first direction for printing and for rotating in a second direction for transporting media to said duplexing path.

3. The fuser of claim 1, including:

a hot roll gear connected to said hot roll; and a swing arm assembly adapted for coupling said hot roll gear to said drive train and for uncoupling said hot roll gear from said drive train.

4. The fuser of claim 1, said frame including a plate and said motor and said drive train being associated with said plate for positioning thereby.

5. A drive system for a fuser having a fuser unit frame and a hot roll mounted in the frame, said drive system comprising:

a motor mounted in the frame, said motor being a bidirectional motor; and a drive train operatively connected to said motor, said drive train including a plurality of individual gears each mounted to said frame and including a hot roll gear in said drive train for driving said hot roll, said drive train adapted to be engaged with and disengaged from said hot roll gear, said drive train being disengaged from said hot roll gear during duplex routing of media through the fuser.

6. The drive system of claim 5, said drive train including a swing arm assembly selective coupled to and uncoupled from said hot roll gear.

7. The drive system of claim 6, said frame including a plate, and said motor and said drive train being connected to said plate for positioning thereby.

8. The drive system of claim 5, said frame including a plate and said motor and said drive train being connected to said plate for positioning thereby.

9. The drive system of claim 5, including a swing arm assembly having a bracket and a primary gear connected in said drive train for rotation by said drive motor and a further gear connected to said bracket and rotated by said primary gear, said further gear being couplable to and uncouplable from said hot roll gear upon movement of said bracket.

10. The drive system of claim 9, said frame including a plate and said motor, said drive train and said swing arm assembly being mounted to said plate.

11. A method for operating a fuser of an EP printing device, said method comprising:

providing a frame, a hot roll, a drive train and a drive motor;

providing a hot roll gear as part of the drive train, the hot roll gear being connected to the hot roll for rotating the hot roll;

operating the drive motor in a first direction when passing media past the hot roll;

operating the drive motor in an opposite direction for routing the media to a duplexing path; and a swing arm assembly having gears driven by the drive train, one of the gears of the swing arm assembly being driving coupled with and uncoupled from the hot roll gear; and moving the swing arm assembly upon reversals of the drive motor between the first direction and the opposite direction for coupling and uncoupling the hot roll gear.

12. The method of claim 11, including maintaining continuous driving connection between the drive motor and the drive train during reversals in direction of rotation of the motor.

13. A method for operating a fuser of an EP printing device, said method comprising:

providing a frame, a hot roll, a drive train and a drive motor;

providing a hot roll gear as part of the drive train, the hot roll gear being connected to the hot roll for rotating the hot roll;

operating the drive motor in a first direction when passing media past the hot roll;

operating the drive motor in an opposite direction for routing the media to a duplexing path; and one of coupling the hot roll gear with the drive train and uncoupling the hot roll gear from the drive train upon reversals in direction of rotation of the motor.

* * * * *